US008382329B2

(12) United States Patent
Lutz et al.

(10) Patent No.: US 8,382,329 B2
(45) Date of Patent: Feb. 26, 2013

(54) ADJUSTABLE BEAM LAMP

(75) Inventors: William Ronald Lutz, Cumming, GA (US); Gavin McCalla, Dana Point, CA (US)

(73) Assignee: Innovx Group LLC, Laguna Niguel, CA (US)

( * ) Notice: Subject to any disclaimer, the term of this patent is extended or adjusted under 35 U.S.C. 154(b) by 329 days.

(21) Appl. No.: 12/679,843

(22) PCT Filed: May 14, 2009

(86) PCT No.: PCT/US2009/043999
§ 371 (c)(1),
(2), (4) Date: Jun. 25, 2010

(87) PCT Pub. No.: WO2009/140528
PCT Pub. Date: Nov. 19, 2009

(65) Prior Publication Data

US 2010/0264821 A1 Oct. 21, 2010

Related U.S. Application Data

(60) Provisional application No. 61/053,512, filed on May 15, 2008.

(51) Int. Cl.
*F21V 19/02* (2006.01)

(52) U.S. Cl. ..... 362/285; 362/372

(58) Field of Classification Search ..... 313/113, 313/114; 362/294, 296.08, 232, 285, 372
See application file for complete search history.

(56) References Cited

U.S. PATENT DOCUMENTS 5,072,347 A * 12/1991 Brunson ..... 362/194
5,408,393 A 4/1995 Becker
(Continued)

FOREIGN PATENT DOCUMENTS

| | | |
|---|---|---|
| CA | 2724319 | 11/2010 |
| TW | 98116025 | 12/2009 |
| WO | WO/2009/140528 | 11/2009 |

OTHER PUBLICATIONS

International Preliminary Report on Patentability and Written Opinion issued Nov. 17, 2010 for WO/2009/140528 (PCT/US2009/043999) (6 pages).

(Continued)

*Primary Examiner* — Mariceli Santiago
*Assistant Examiner* — Glenn Zimmerman
(74) *Attorney, Agent, or Firm* — Ballard Spahr, LLP

(57) ABSTRACT

A lamp device having first and second ends comprising a glass lens positioned on the first end of the lamp and a socket positioned on the second end of the lamp. The lamp is configured with a parabolic reflecting surface lining the interior side walls of a top portion of the lamp and an array of LEDs or other light emitting device positioned within that the top portion of the lamp. The array of LEDs or other light emitting device are operatively connected to the socket in order to receive power. The lamp may also be configured to facilitate movement of the glass lens closer to and further away from the array of LEDs or other light emitting device in order to shorten or lengthen the focal point of the light beam created by the array of LEDs or other light emitting device. Alternatively, the lamp may be configured to facilitate movement of the array of LEDs or other light emitting device closer to and further away from the glass lens in order to shorten or lengthen the focal point of the light beam created by the array of LEDs or other light emitting device.

13 Claims, 9 Drawing Sheets

U.S. PATENT DOCUMENTS

| | | | | |
|---|---|---|---|---|
| 5,410,461 | A * | 4/1995 | Petzl | 362/232 |
| 5,630,661 | A | 5/1997 | Fox | |
| 6,866,401 | B2 * | 3/2005 | Sommers et al. | 362/268 |
| 7,001,041 | B2 * | 2/2006 | Halasz et al. | 362/205 |
| 7,699,491 | B2 * | 4/2010 | Sharrah et al. | 362/191 |
| 2007/0070620 | A1 | 3/2007 | Theriault et al. | |
| 2007/0109775 | A1 | 5/2007 | Chen | |
| 2009/0207615 | A1 * | 8/2009 | Frick | 362/279 |

OTHER PUBLICATIONS

International Search Report mailed Jun. 26, 2009 for WO/2009/140528 (PCT/US2009/043999) (3 pages).

U.S. Appl. No. 61/053,512, filed May 15, 2008, W. Ron Lutz.

* cited by examiner

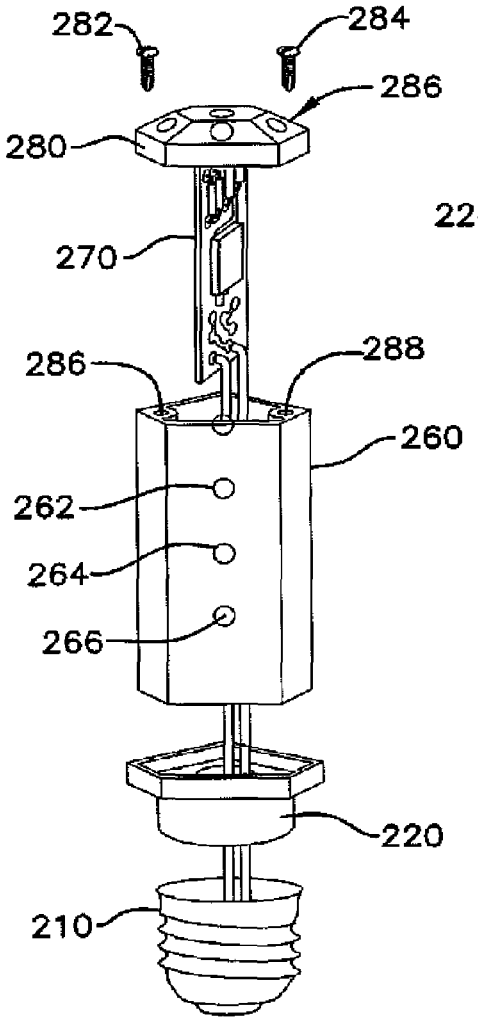
FIG. 11
FIG. 12
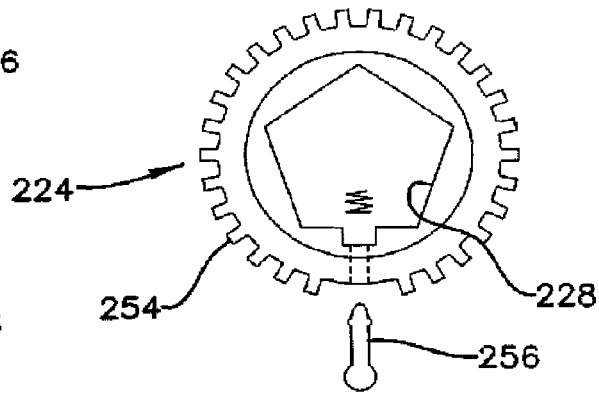

ADJUSTABLE BEAM LAMP

This application is a National Stage Application of PCT/US2009/043999, filed May 24, 2009, and which claims the benefit of U.S. Provisional patent application Ser. No. 61/053,512, filed May 15, 2008, and which applications are incorporated herein by reference. To the extent appropriate, a claim of priority is made to each of the above disclosed applications.

FIELD OF THE INVENTION

The instant invention relates to a need for a lighting lamp configured to handle several applications, wherein the lighting lamp is configured to be adjusted so as to facilitate generation of light ranging from a wide beam flood to a narrow beam spot.

BACKGROUND OF THE INVENTION

Today, when visiting a retail establishment that offers lighting lamps for sale, a consumer will see a wide variety of pars and reflector lamps that all have various beam spreads, light output and wattage concerns. There is a need for a lighting lamp configured to handle several applications, wherein the lighting lamp is configured to be adjusted so as to facilitate generation of light ranging from a wide beam flood to a narrow beam spot.

In recent years, improved light emitting diodes (LEDs) have become available that produce relatively high intensities of output light. These higher power LEDs, for example, have enabled use of LEDs in light fixtures and the like. The improving capability of LEDs and the decreasing cost of the LEDs is making LED based lighting a viable alternative to more traditional lighting, such as incandescent and fluorescent lights, and will soon allow LED lighting to surpass such older technologies and will likely be surpassed itself in the future. Regardless of the light emitting technology utilized, a selectively adjustable lighting lamp that adjusts beam patterns to suit the application provides utility to the user.

BRIEF DESCRIPTION OF THE DRAWINGS

Non-limiting and non-exhaustive embodiments are described with reference to the following figures, wherein like reference numerals refer to like parts throughout the various views unless otherwise specified.

FIG. 11 depicts an exploded view of the LED, driver and socket assembly of a second embodiment of the present invention including an extruded aluminum housing heat sink;

FIG. 12 depicts a top view of outer die cast heat sink showing internal aperture detail that mates to the LED an extruded aluminum housing heat sink;

SUMMARY

Figure 2:
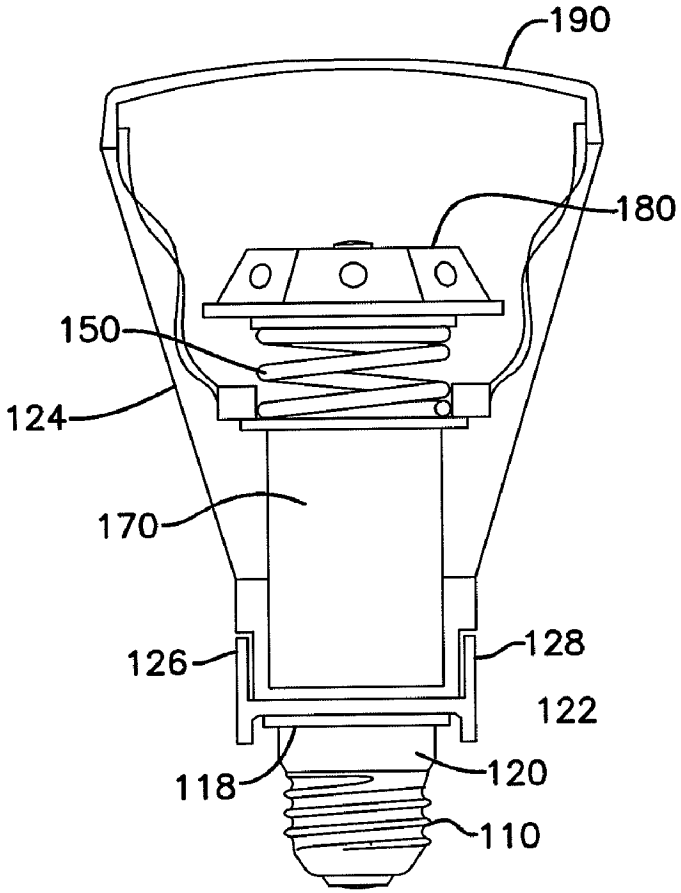
FIG. 2 depicts a sectional view of a completed assembly of an embodiment of a first embodiment of the present invention.

A lamp device having first and second ends comprising a lens positioned on a first end of the lamp and a socket positioned on a second end of the lamp. The lamp is configured with a parabolic reflecting surface lining the interior side walls of at least a portion of the top portion of the lamp and an array of LEDs or other light emitting source positioned within that the top portion of the lamp. The array of LEDs or other light emitting sources are operatively connected to the socket in order to receive power. The lamp is configured to facilitate movement of the lamp components so that the LEDs or other light emitting source positioned within that the top portion of the lamp may be moved closer to and further away from the lamp lens in order to shorten or lengthen the focal point of the light beam created by the array of LEDs or other light emitting source. In one embodiment, the lamp may be configured to facilitate movement of the array of LEDs or other light emitting device closer to and further away from the lens in order to shorten or lengthen the focal point of the light beam created by the array of LEDs or other light emitting source. Alternatively, the LEDs or other light emitting device may be stationary and the lens may be moved closer to or further away from the LEDs or other light emitting source.

DETAILED DESCRIPTION

The present invention is a lighting lamp configured such that the light emitting source within the lamp is adjustable between a plurality of positions in order to increase or decrease the distance between the light emitting source and at least a portion of a lens. It is contemplated that the lens may be comprised of glass, plastic or any other material that may be used in the creation of a lens. The light emitting source may take on any of the myriad of light emitting configurations, including incandescent lighting devices, fluorescent lighting devices, and LEDs. The configuration of the lens and lamp housing in embodiments of the invention include a plurality of configurations that may resemble currently available configurations wherein some embodiments may include a lens portion and some may not. In embodiments including a lens portion, the lens may comprise any of a plurality of lens configurations, including but not limited to clear and diffused lenses having varying thickness, shape and size, depending on the application.

One embodiment of the present invention is a lamp that utilizes LED's in a chip format on a circuit board as the light emitting source. The LEDs run at elevated voltages, which thereby cause the LEDs to output elevated levels of light. The lamp is configured to allow for the adjustment of the focal length of the optical system of the lamp and thereby the beam pattern. By adjusting the focal length, the distance between the lens and the focal point measured along the optical axis of the lamp, the light beam pattern may be varied within a range beginning with a wide beam flood to a narrow beam spot. Lamps configured in accordance with the disclosed embodiments of the present invention facilitate adjustment of the focal length of the lamp by configuring at least the light-emitting portion of the lamp for movement within a reflector assembly. The lamp is comprised of an LED driver or other light emitting device and socket assembly, a lens, heat sink, parabola reflector and a beam adjustment assembly. The LED driver or other light emitting device and socket assembly is comprised of at least an LED platen or other light emitting device operatively connected to a driver circuit board, a standard Edison type screw-in base, and extruded aluminum heat sink housing. The lamp is configured for movement of the LED platen closer to or further away from the lens, which in some embodiment may be configured to focus light emitted by the LEDs and in another embodiment diffuse the light emitted by the LEDS.

Figure 1:
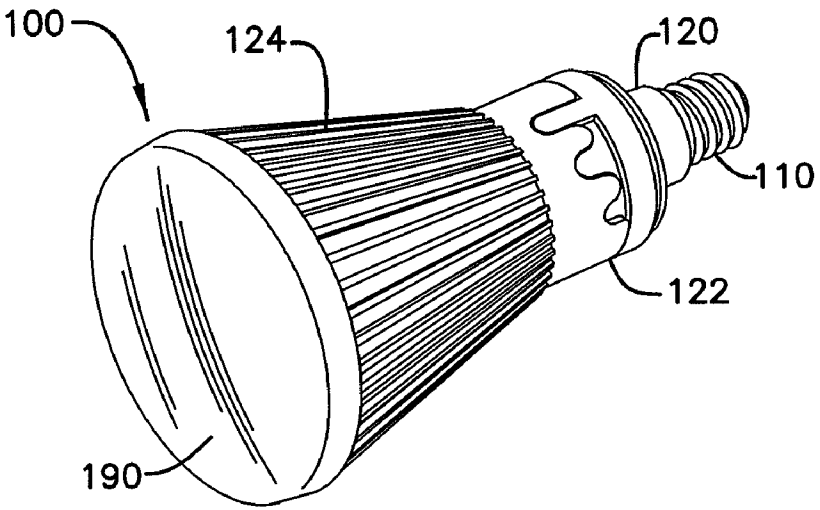
FIG. 1 depicts a perspective view of a first embodiment of the present invention in medium Flood mode.

A first embodiment of a lamp configured to allow for the adjustment of the lamp's focal length, in order to facilitate various beam spreads, is illustrated in FIG. 1-9. FIG. 1 illustrates an assembled view of an LED type lamp 100. As illustrated, the LED lamp 100 is comprised of an outer casing 124, configured to also function as a secondary heat sink, a focal length adjustment assembly 122, an adapter 120 configured to attach the LED driver assembly to the standard Edison type screw-in base 110, and a lens 190 fittingly connected as a cap onto the outer casing 124. FIG. 2 illustrates an assembled sectional view of the LED lamp 100, showing the standard Edison type screw-in base 110 an adapter 120 configured to attach the array of LEDs 186, positioned on the LED platen 180, and driver circuitry 170 to the standard Edison type screw-in base 110. As illustrated, a focal length adjustment assembly 122, which in the embodiment illustrated is a rotating ring configured with adjustment prongs 126 and 128 for shortening or lengthening the focal point of the light beam created by the array of LEDs 186.

Figure 3:
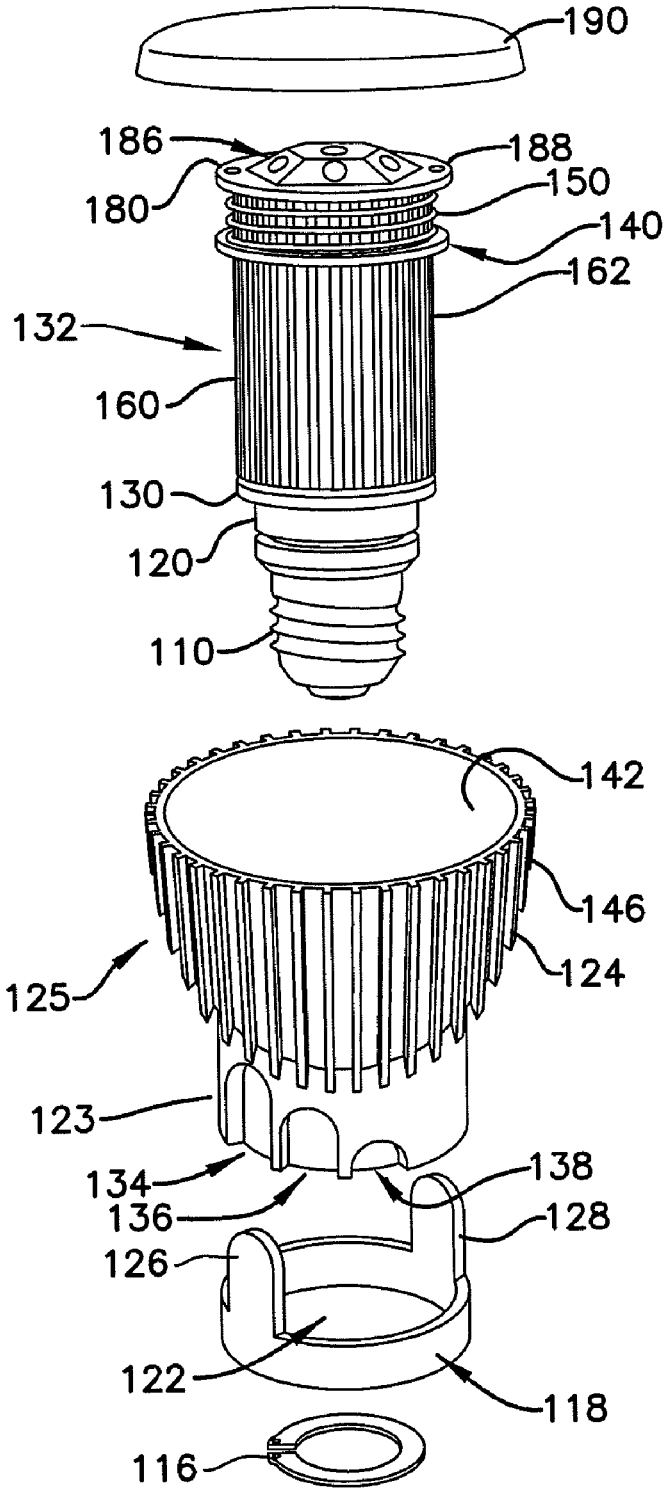
FIG. 3 depicts an exploded view of a completed assembly of a first embodiment of the present invention.
Figure 4:
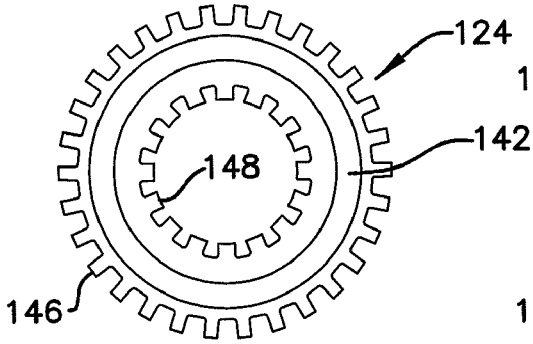
FIG. 4 depicts a top view of outer die cast heat sink showing internal aperture detail that mates to the LED heat sink assembly.

As further illustrated in an exploded assembly view, FIG. 3 further shows the components of the first embodiment of the LED lamp 100. As illustrated, the top portion of the LED lamp is comprised of a lens 190, an LED driver and socket assembly 132, an exterior aluminum heat sink 124, a focal length adjustment assembly 122, collar retention ring 118 and a retention clip 116. The LED driver and socket assembly 132 includes an LED platen 180, comprised of an array of LEDs 186 and a heat sink back plate 188 along, with the driver circuit board (not shown) mounted perpendicular thereto (as illustrated in FIG. 4) and sized to be positioned down inside of a first LED and driver board heat sink 160. As illustrated, the first LED and driver board heat sink 160 is an extruded aluminum heat sink configured with longitudinally extending fins 162. Over the first LED and driver board heat sink 160 and underneath the LED platen 180, a compression spring 150 is positioned to provide linear stabilizing pressure to the socket assembly 132 that moves linearly in response to rotation of the focal length adjustment assembly 122 and engagement of adjustment prongs 126 and 128 with one of the plurality of beam adjustment notches 132, 134, 136.

The LED lamp's exterior aluminum heat sink 124 is also configured with longitudinally extending fins 146 on its exterior surface and a blue parabolic reflector casting 142 along a portion of its interior surface. It is contemplated that the portion of the interior of the blue parabola surface 142 has been polished out and/or inserted with a mirrored reflector. Alternatively, commercially available methods capable of generating a smooth reflector surface 142 along the interior of the exterior aluminum heat sink 124 may be used. As illustrated in FIG. 4, the exterior aluminum heat sink 124 has a funnel shaped upper portion 125 wherein the walls 142 of the upper portion 125 are angled inward until the internal diameter becomes uniform beginning with a geared tooth aspect 148 within a lower portion 123. The geared portion 148 along the interior of the lower portion of the exterior aluminum heat sink 124 perform as guiding members configured to mate with the fins 162 extending longitudinally out from the exterior of the first LED and driver board heat sink 160 as it is positioned within and slid up and down the interior of the exterior aluminum heat sink 124. As shown in FIG. 3, the lower portion 123 further includes, on its exterior, a plurality of beam adjustment notches 134, 136, 138, each configured to be engaged by first and second focal length adjustment arms 126 and 128 of the focal length adjustment assembly 122. The focal length adjustment assembly 122 causes the focal length of the light associated with the array of LEDs 186 to be changed when one of the focal length adjustment prongs 126 and 128 engages one of the plurality of beam adjustment notches 134, 136, 138. It is contemplated that the plurality of beam adjustment notches 134, 136, 138 may be of any number. In the present embodiment there are three, a first beam adjustment notch 134, a second beam adjustment notch 136, and a third beam adjustment notch 138. As illustrated, the beam adjustment notches 134, 136 and 138 are configured on an end opposite the opening within the exterior aluminum heat sink 124 into which the first LED and driver board heat sink 160 is inserted. The LED driver and socket assembly 132 also includes a ceramic insulator gasket 130 sandwiched between an end of the first LED and driver board heat sink 160 and an adapter 120. The adapter 120 is configured for attaching the LED driver assembly to a standard Edison screw base 110.

Figure 5:
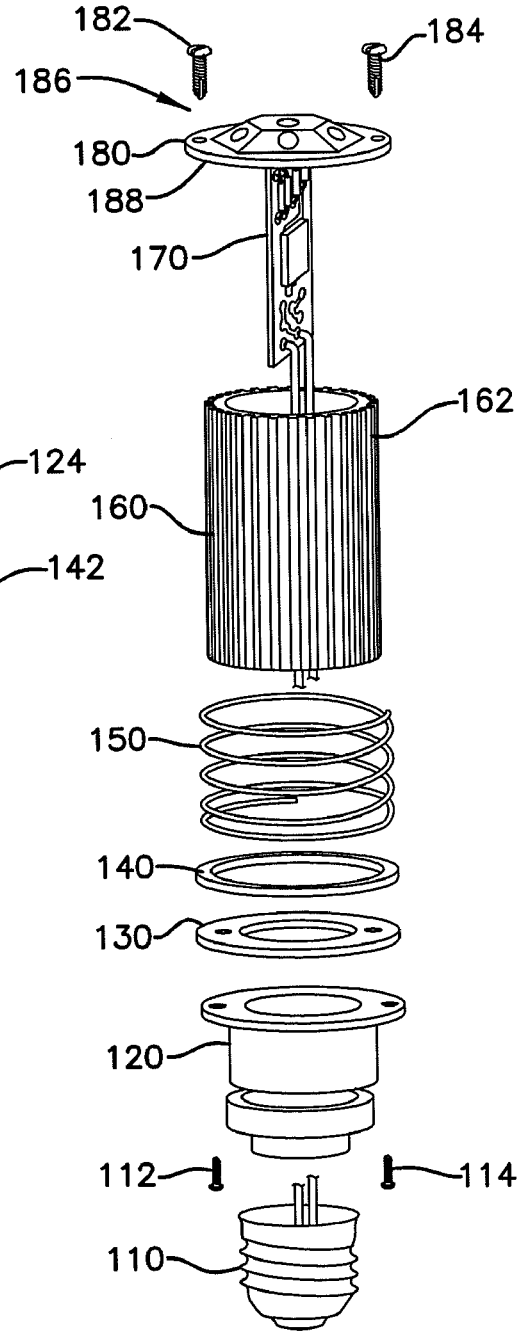
FIG. 5 depicts an exploded view of the LED, driver and socket assembly of a first embodiment of the present invention.
Figure 6:
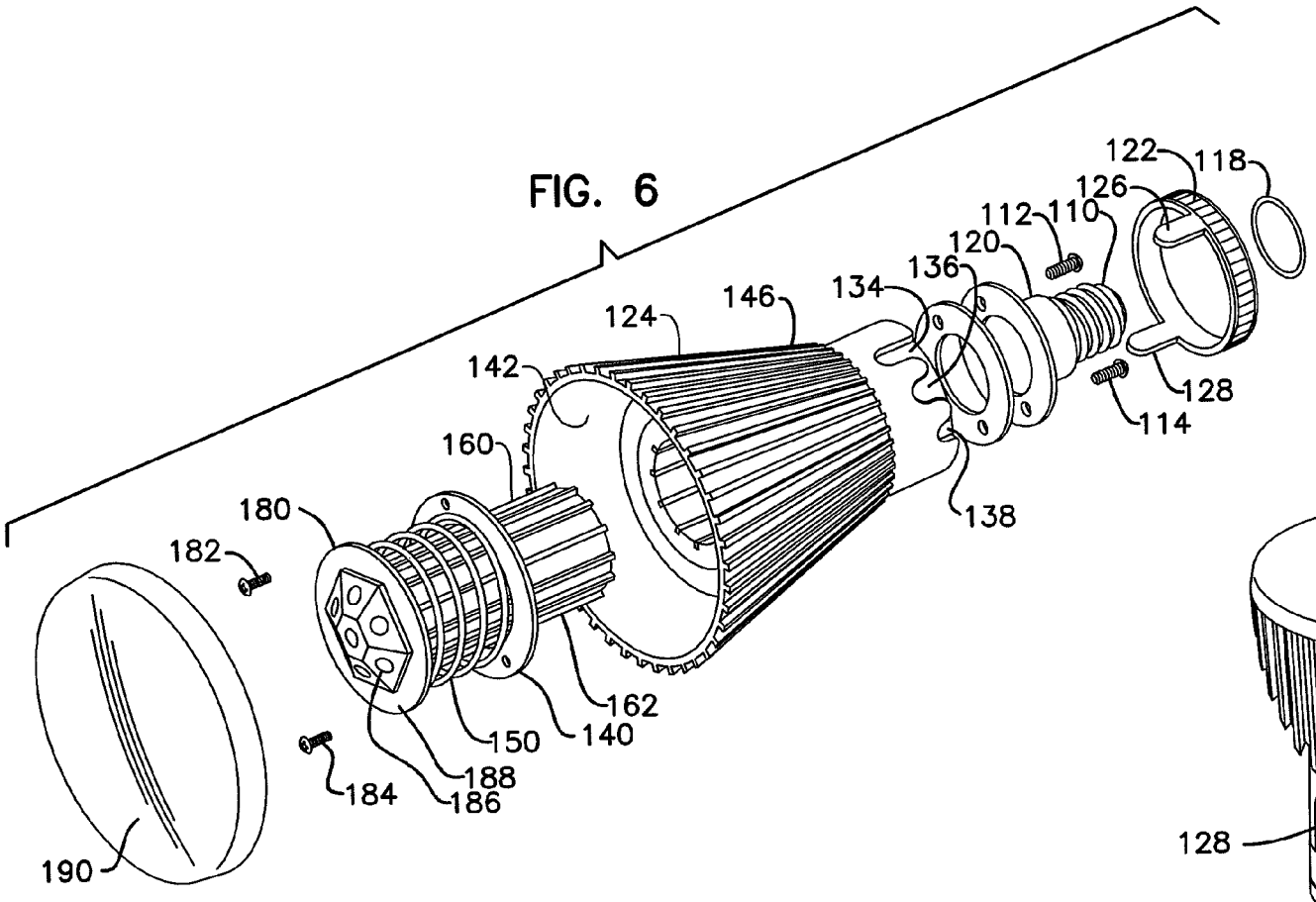
FIG. 6 depicts an exploded view of a completed assembly of a first embodiment of the present invention.

FIG. 5 is an illustration of an exploded view of the LED driver and socket assembly 132. The LED driver and socket assembly 132 includes an LED Platen 180, comprised of an array of LEDs 186 and a heat sink back plate 188 having the driver circuit board 170 mounted perpendicular thereto and sized to be positioned down inside of the first LED and driver board heat sink 160. As illustrated, the first LED and driver board heat sink 160 is an extruded aluminum heat sink configured with longitudinally extending fins 162. The LED driver and socket assembly 132 further includes a compression spring 150, a retention collar 140, a ceramic insulator gasket 130, an adapter 120 and a standard Edison screw base 110. The adapter 120 is configured for attaching the LED driver assembly to the standard Edison screw base 110. Self-tapping screws 112 and 114 attach the adapter 120 to the first LED and driver board heat sink 160. Self-tapping screws 182 and 184 attach the LED Platen 180 to the first LED and driver board heat sink 160. FIG. 6 illustrates a complete exploded assembly view of the first embodiment of the LED lamp 100.

The present embodiment includes a plurality of heat sinks as the design is configured to remove as much heat out as possible. It is contemplated that additional heat sinks and other configurations may be utilized to accomplish the objective of removing heat. The specific design illustrated herein is not set forth in a limiting sense but simply as an embodiment of a design comprising multiple heat sinks, including, LED array heat sink back plate 188, the first LED and driver board heat sink 160 and the exterior aluminum heat sink 124. It is also contemplated that lamp configurations that do not include LEDs as a lighting source or may not require heat reduction components may be configured without heat sink components.

Figure 7:
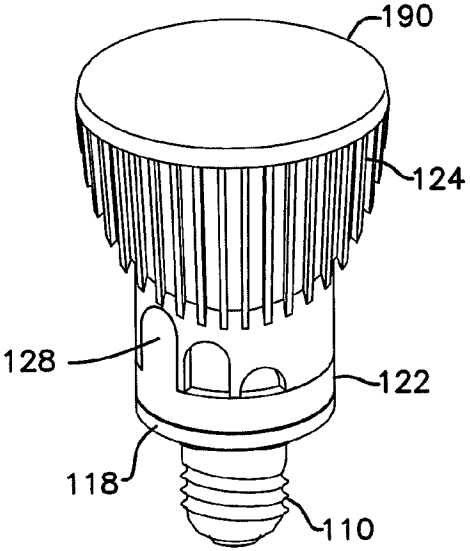
FIG. 7 depicts a side view of a first embodiment of present invention in Flood mode.
Figure 8:
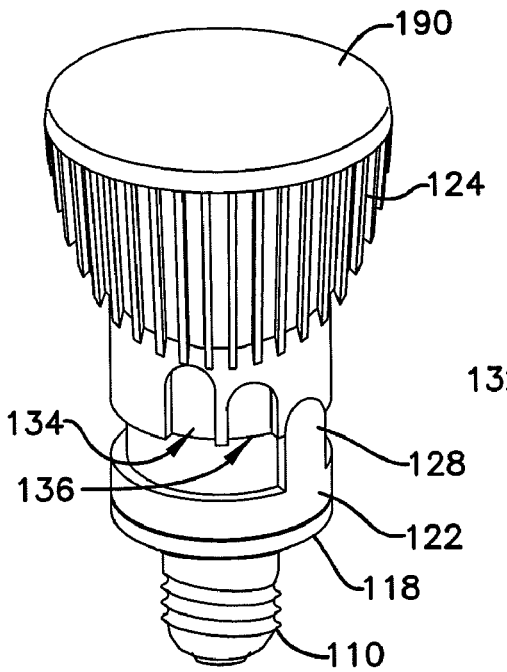
FIG. 8 depicts a side view of a first embodiment of the present invention illustrating the adjustment rings slidably engaged to adjust the lighting mode.
Figure 9:
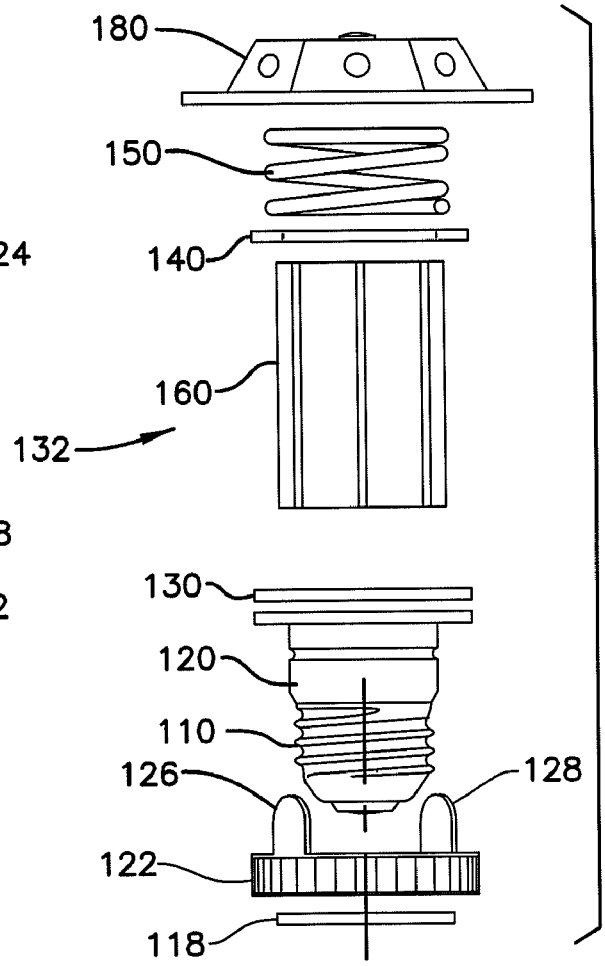
FIG. 9 depicts an exploded side view of the LED, driver and socket assembly of an embodiment of a first embodiment of the present invention.

As illustrated in FIG. 7, the embodiment illustrated includes a focal length adjustment assembly 122 that may be manipulated to engage one of a first, second or third beam adjustment notches 134, 136, 138 that facilitate a change of the positioning of the LED driver and socket assembly 132 within the exterior aluminum heat sink 124 between three varying heights. When the LED driver and socket assembly 132 is pushed down into the interior of the exterior aluminum heat sink 124, the focal length adjustment assembly 122 is pushed upward past the base 110 along with a retaining ring (not shown) that engages a grooved area positioned just atop the LED driver assembly to the base 110. The LED driver assembly 132 is retained and comprises the spring loaded assembly illustrated. As illustrated, the focal length adjustment prong 128 engages the first beam adjustment notch 134. When a user pulls the focal length adjustment collar 122 downward and turns it slightly to the right, as illustrated in FIG. 8, the user may adjust the device to another index point by causing the focal length adjustment prong 128 to engage the third beam adjustment notch 138, thereby changing the location of the array of LEDs on the LED platen 180 within the parabolic reflector. The closer the array of LEDs on the LED platen 180 are to the lens 190, the more a flood effect is created. Conversely, the further the array of LEDs on the LED platen 180 are from the lens 190, retracted down into the parabolic reflector assembly, the narrower the light beam output. The embodiment illustrated in FIGS. 1-9, is configured to facilitate three indexed focal length adjustments that provide three different locations of the array LEDs within the parabolic reflector assembly.

Figure 10:
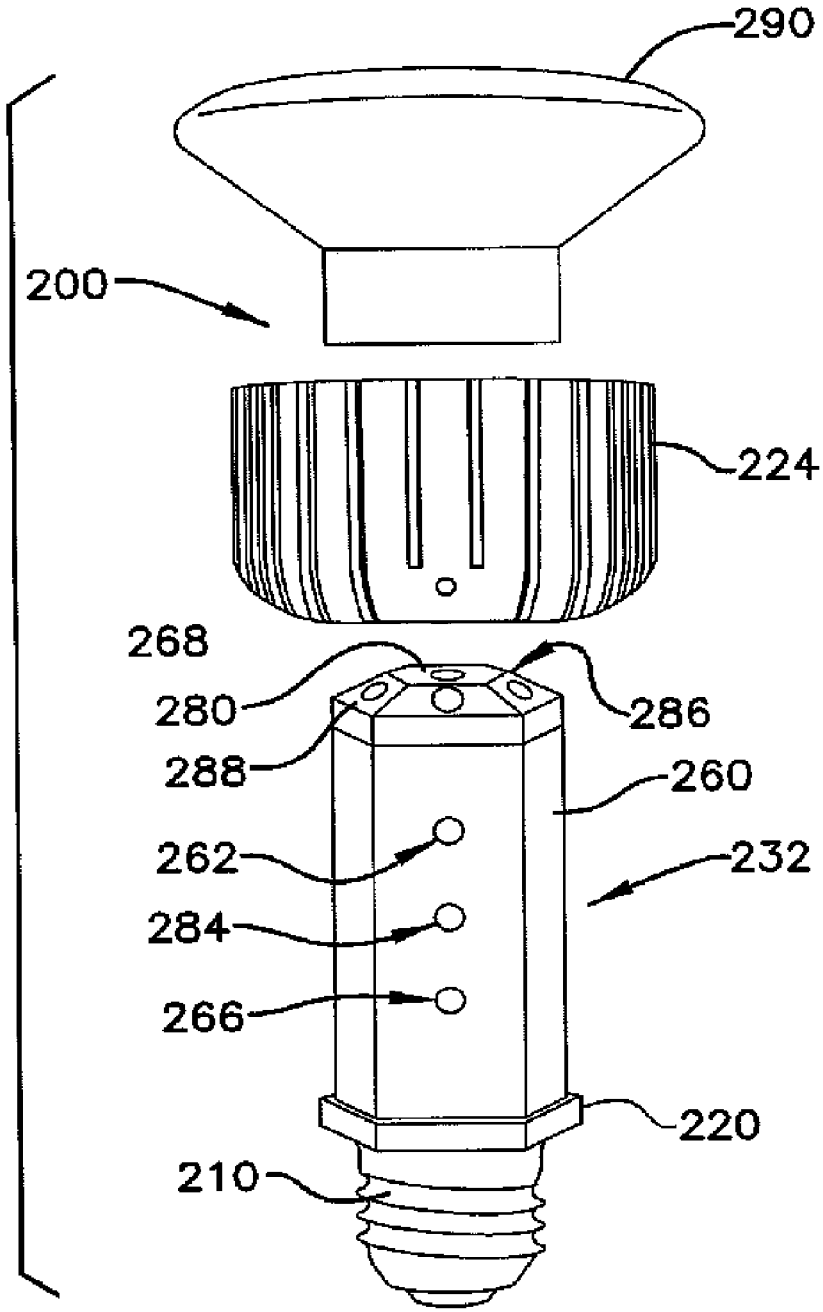
FIG. 10 depicts an exploded view of a completed assembly of a second embodiment of the present invention including an extruded aluminum housing heat sink.

An alternative embodiment of an LED lamp utilizing LED's in a chip format on a circuit board that are run at elevated voltages is illustrated in FIGS. 10-14. FIG. 10 illustrates an exploded assembly view of a second embodiment of the LED lamp 200. As illustrated, the top portion of the LED lamp is comprised of a glass parabola 290, an LED driver and socket assembly 232, and an exterior aluminum heat sink 224. The LED driver and socket assembly 232 includes an LED Platen 280, comprised of an array of LEDs 286 and a heat sink back plate 288 having a driver circuit board (not shown) mounted perpendicular thereto (as illustrated in FIG. 11) and sized to be positioned down inside of an LED and driver board heat sink 260. As illustrated, the LED and driver board heat sink 260 is an extruded aluminum heat sink having a pentagonal configuration. The LED lamp's exterior aluminum heat sink 224 has a hollow interior configuration. A first end of heat sink 224 is configured for receiving the glass parabolic envelope 290 which is seated and permanently epoxied to the interior of the exterior aluminum heat sink 224. A second end of the exterior aluminum heat sink 224 has a pentagonal aperture sized to receive the LED driver and socket assembly 232. The exterior aluminum heat sink 224 also serves as focal length adjustment device when it is slidingly moved up and down the LED and driver board heat sink 260 and positioned at various locations by engaging the ball detent pin 256, which extends through the pin aperture 268 in one of the beam adjustment index apertures 262, 264 and 266. Because the glass parabolic envelope 290 is attached to heat sink 224, when heat sink 224 is slidingly moved up and down the LED and driver board heat sink 260, it causes the focal length of the array of LEDs 186 to be changed. It is contemplated that the plurality of beam adjustment index apertures may be any number, but in the present embodiment there are three, each of which are dictated by a first beam adjustment aperture 262, a second beam adjustment aperture 264, and a third beam adjustment aperture 266. An adapter 220 is configured for attaching the heat sink 260 of LED driver assembly to a standard Edison screw base 210.

FIG. 11 is an illustration of an exploded view of the LED driver and socket assembly 232 of the second embodiment. As illustrated, the LED driver and socket assembly 232 includes an LED Platen 280, comprised of an array of LEDs 286 and a heat sink back plate 288 having the driver circuit board 270 mounted perpendicular thereto and sized to be positioned down inside of the LED and driver board heat sink 260. As illustrated, the LED and driver board heat sink 260 is an extruded aluminum heat sink having a pentagonal configuration. On one of the pentagonal sides, the LED and driver board heat sink 260 includes indexing points 262, 264 and 266 which facilitate setting the relationship of the height of the array of LEDs in order to adjust the focal length. The LED driver and socket assembly 232 further includes an adapter 220 and a standard Edison screw base 110. The adapter 120 is configured for attaching the LED driver assembly to the standard Edison screw base 110. Self tapping screws 282 and 284 attach the LED Platen 280 to the LED and driver board heat sink 260 by screwing into apertures 286 and 288.

FIG. 12 is a top view of a top view of the exterior aluminum heat sink 224, illustrating the pentagonal hole in its bottom through which the LED driver and socket assembly 232 slides through. The ball detent pin 256, configured for spring 254 retention, engages the beam adjustment index apertures 262, 264 and 266 to facilitate locating the relationship of the height of the array of LEDs to the glass parabola 290. The ball detent pin 256 is held in with a retaining spring 254. By retracting pin 256 a user may index the different adjustment index apertures 262, 264 and 266 on the pentagonal LED and driver board heat sink 260. The LED driver and socket assembly 232 slides up and down through pentagonal aperture sized to receive the LED driver and socket assembly 232. By simply pulling retracting pin 256 and either raising or lowering the LED driver and socket assembly 232 through the parabola 290 of the mirrored envelope, the focal point is changed.

Figure 13:
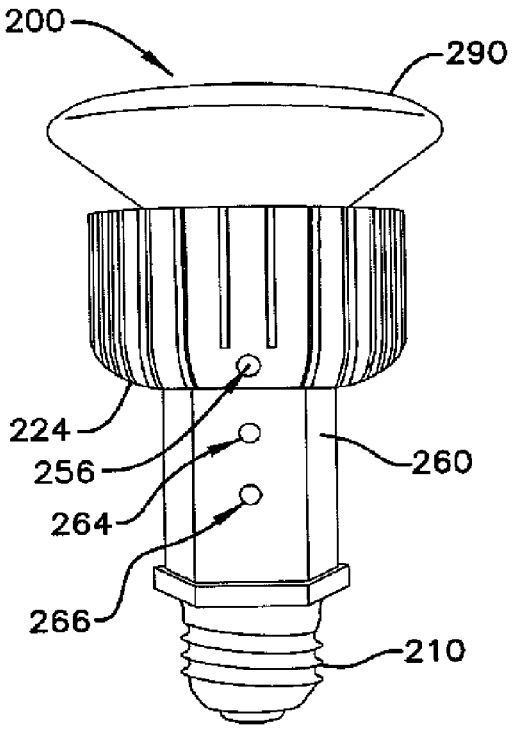
FIG. 13 depicts a side view of a second embodiment of present invention including an extruded aluminum housing heat sink illustrating the spot mode of operation.
Figure 14:
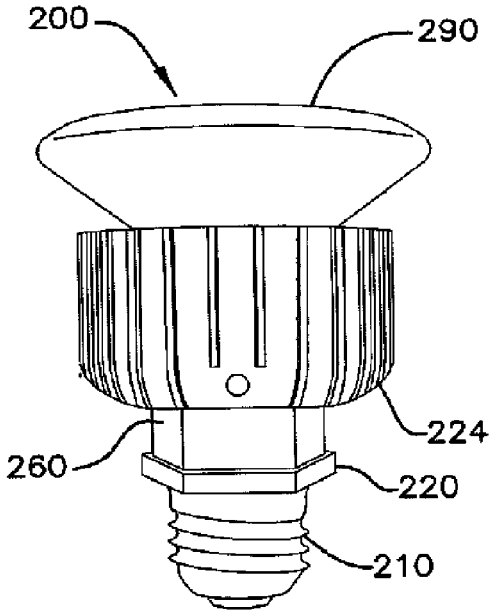
FIG. 14 depicts a side view of a first embodiment of the present invention including an extruded aluminum housing heat sink illustrating the flood mode of operation.

As illustrated in FIG. 13, moving the LED driver and socket assembly 232 downward through the barrel of the parabolic reflector, the LED lamp 200 generates more of a spot beam pattern because the array of LEDs are positioned further away from the lens portion of the parabola 290. And, as illustrated in FIG. 14, moving the LED driver and socket assembly 232 upward in the barrel of the glass parabola 290 causes the array of LEDs to be positioned closer to the lens portion of the parabola 290, thereby creating an increased flood pattern. As illustrated, the retracting pin 256 is positioned into the third adjustment aperture 266.

Figure 15:
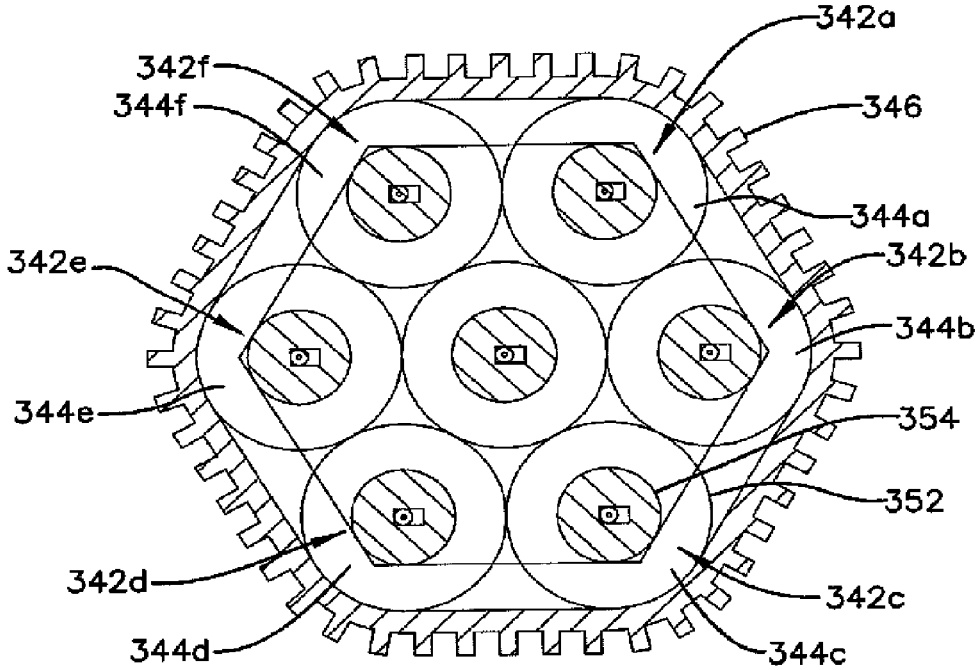
FIG. 15 depicts a sectional view of a third embodiment of the present invention.
Figure 16:
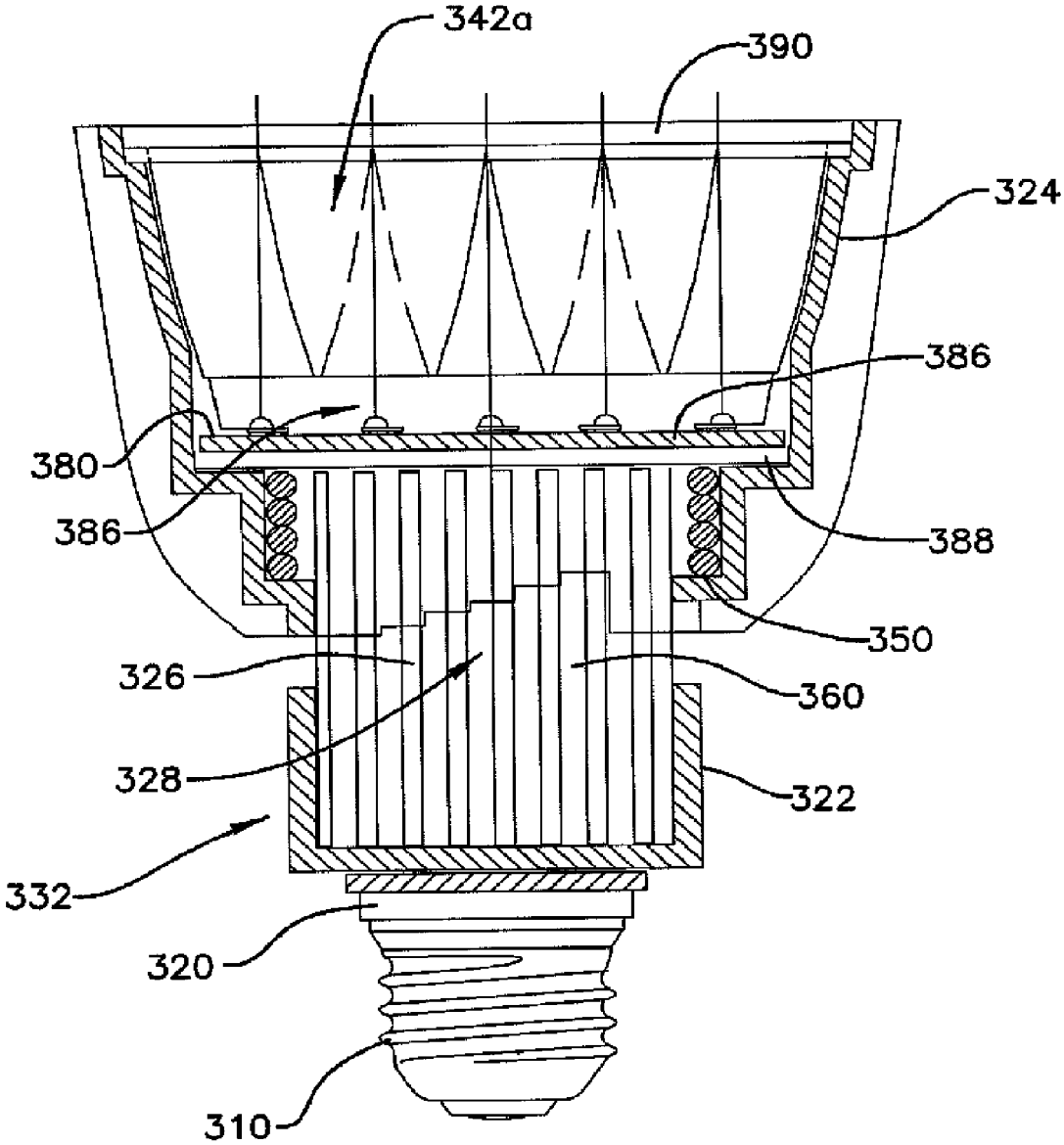
FIG. 16 depicts a top view of a third embodiment of the present invention.

Another embodiment of a lamp configured to allow for the adjustment of the focal length of the lamp, in order to facilitate various beam spreads, is illustrated in FIGS. 15 and 16. As shown, FIGS. 15 and 16 illustrates an assembled view of a third embodiment of an LED type lamp 300. As illustrated, the LED lamp 300 is comprised of an outer casing 324 configured to also function as a secondary heat sink, a focal length adjustment collar 322, an adapter 320 configured to attach the LED driver assembly to the standard Edison type screw-in base 310, and a lens 390 fittingly connected to and positioned as a cap onto the outer casing 324. An array of LEDs 386 are positioned on the LED platen 380, which may be adjusted upward or downward as a result of the manipulation of the focal length adjustment collar 322. The focal length adjustment collar 322 is a rotating ring configured with an adjustment prong 326 for shortening or lengthening the focal point of the light beam created by the array of LEDs 386.

As illustrated, the top portion of the LED lamp is comprised of a lens 390, an LED driver and socket assembly 332, an exterior aluminum heat sink 360, a focal length adjustment collar 322, and a collar retention ring 320. The LED driver and socket assembly 332 includes an LED Platen 380, comprised of an array of LEDs 386 and a heat sink back plate 388, with the driver circuit board (not shown) mounted perpendicular thereto and sized to be positioned down inside of driver board heat sink 360. As illustrated, the first LED and driver board heat sink 360 is an extruded aluminum heat sink configured with longitudinally extending fins 362. Over the top portion of the driver board heat sink 360 and underneath the LED platen 380 a compression spring 350 is positioned to provide linear stabilizing pressure between focal length adjustment collar 322 and outer casing 324 which is biased by spring 350 to allow the LED driver and socket assembly 332 to move linearly, causing the LED platen 380 to be moved closer to and/or further away from lens 390.

The LED lamp's exterior aluminum heat sink 324 is also configured with longitudinally extending fins 346 on its exterior and on its interior is a plurality of conical shaped parabolic reflectors 342*a*, 342*b*, 342*c*, 342*d*, 342*e*, 342*f*, each of which is approximately 25 mm in diameter and 28 mm in height and includes a blue parabolic reflector casting 344*a*, 344*b*, 344*c*, 344*d*, 344*e*, 344*f* along a portion of its interior surface. It is contemplated that the portion of the interior of the blue parabola surface, 344*b*, 344*c*, 344*d*, 344*e*, 344*f* has been polished out and/or inserted with a mirrored reflector. Alternatively, commercially available methods capable of generating a smooth reflector surfaces, 344*b*, 344*c*, 344*d*, 344*e*, 344*f* along the interior of the conical shaped parabolic reflectors 342*a*, 342*b*, 342*c*, 342*d*, 342*e*, 342*f* may be used. The upper portion of the exterior aluminum heat sink 224 has a funnel shaped upper portion wherein the interior walls of the upper portion are angled inward facilitating the adjacent fitting of the plurality of conical shaped parabolic reflectors 342*a*, 342*b*, 342*c*, 342*d*, 342*e*, 342*f* therein. The lower portion of the exterior aluminum heat sink 324 includes, on its exterior, a plurality of beam adjustment notches 328 each configured to be engaged by a focal length adjustment arm 326 which extends from focal length adjustment collar 322. The focal length adjustment collar 322 causes the focal length of the array of LEDs 386 to be changed when the focal length adjustment arm 326 which extends from focal length adjustment collar 322 engages one of the plurality of beam adjustment notches 328. Although the present embodiment illustrates five beam adjustment notches 328 on the lower portion of the exterior aluminum heat sink 324, it is contemplated that the of plurality of beam adjustment notches 328 may be of any number. It is also contemplated that the focal length adjustment collar 322 and the exterior aluminum heat sink 324 may be configured to allow for a plurality of smaller increments that may be engaged by a sliding configuration that facilitates smaller incremental changes in the distance between the array of LEDs 386 and the lens 390.

Reference may be made throughout this specification to "one embodiment," "an embodiment," "embodiments," "an aspect," or "aspects" meaning that a particular described feature, structure, or characteristic may be included in at least one embodiment of the present invention. Thus, usage of such phrases may refer to more than just one embodiment or aspect. In addition, the described features, structures, or characteristics may be combined in any suitable manner in one or more embodiments or aspects. Furthermore, reference to a single item may mean a single item or a plurality of items, just as reference to a plurality of items may mean a single item. Moreover, use of the term "and" when incorporated into a list is intended to imply that all the elements of the list, a single item of the list, or any combination of items in the list has been contemplated.

This written description uses examples to disclose the invention, including the best mode, and also to enable any person skilled in the art to make and use the invention. The patentable scope of the invention is defined by the application claims, and may include other examples that occur to those skilled in the art. Such other examples are intended to be within the scope of the application claims if they have structural elements that do not differ from the literal language of the application claims, or if they include equivalent structural elements with insubstantial differences from the literal languages of the application claims.

One skilled in the relevant art may recognize, however, that the invention may be practiced without one or more of the specific details, or with other methods, resources, materials, etc. In other instances, well known structures, resources, or operations have not been shown or described in detail merely to avoid obscuring aspects of the invention.

While example embodiments and applications of the present invention have been illustrated and described, it is to be understood that the invention is not limited to the precise configuration and resources described above. Various modifications, changes, and variations apparent to those skilled in the art may be made in the arrangement, operation, and details of the methods and systems of the present invention disclosed herein without departing from the scope of the application claims.

We claim:

1. A lamp device having first and second ends comprising:

a lens positioned on the first end of the lamp;

a lamp casing including a parabolic reflecting surface lining a portion of an interior side wall assembly of the lamp casing and wherein the lamp casing exterior is conical funnel shaped;

an LED socket assembly including a light emitting device positioned at a first end and a socket positioned at a second end, said light emitting device being operatively connected to the socket, wherein the LED socket assembly is positioned within the interior of the lamp casing in a manner whereby the socket of the LED socket assembly extends through and out of a second end of the lamp casing, and the light emitting device of the LED socket assembly is positioned entirely within the parabolic reflecting surface and below the lens; and a focal length adjustment assembly operatively connected to the LED socket assembly in a manner that facilitates linear movement of the LED socket assembly closer to and further away from the lens in order to shorten or lengthen the focal point of the light beam created by the light emitting device.

2. The lamp device of claim 1 wherein the light emitting device is an array of LEDs.

3. The lamp device of claim 1 wherein the lens is comprised of glass.

4. The lamp device of claim 1 wherein the lens is comprised of plastic.

5. The lamp device of claim 2 wherein the lens facilitates diffusion of light generated by the array of LEDs.

6. The lamp device of claim 1 wherein the lamp casing is aluminum and operative structured to perform as a heat sink.

7. The lamp device of claim 1 wherein the LED socket assembly includes at least:

an LED platen having an array of LEDs position thereon, a driver board heat sink; and a driver circuit board electrically connected to the LEDs and sized to be positioned within the driver board heat sink.

8. A lamp having first and second ends comprising:

a lens positioned on the first end of the lamp a housing having first and second open ends including a parabolic reflecting surface lining the interior side walls of at least a portion of the housing and wherein the housing exterior is conical funnel shaped;

a socket positioned on the second end of the lamp; and a light emitting assembly positioned through the second open end of the housing and being operatively connected to the socket, the light emitting assembly including an array of LEDs positioned on an LED platen and entirely within the parabolic reflecting surface, wherein the lamp is further configured to facilitate linear movement of the light emitting assembly within the housing, wherein the array of LEDs positioned on an LED platen and are positioned to facilitate reflection of light emitted by the array of LEDs off of the parabolic reflecting surface through the lens.

9. A lamp device having first and second ends comprising:

a lens positioned on the first end of the lamp;

a lamp casing including a plurality of cones each comprised of a side wall assembly angled inward and open at first and second ends, wherein each side wall assembly includes a parabolic reflecting surface lining at least a portion of the interior of the side wall assembly;

an LED socket assembly having a plurality of LEDs at a first end and a socket positioned at a second end, said plurality of LEDS being operatively connected to the socket, wherein the LED socket assembly is positioned within the interior of the lamp casing in a manner whereby the socket of the LED socket assembly extends through and out of a second end of the lamp casing, and each of the plurality of LEDs are positioned at the second end of one of the plurality of cones; and a focal length adjustment assembly operatively connected to the LED socket assembly in a manner that facilitates linear movement of the LED socket assembly closer to and further away from the lens in order to shorten or lengthen the focal point of the light beam created by the plurality of LEDs.

10. The lamp device of claim 9 wherein the lens is comprised of glass.

11. The lamp device of claim 9 wherein the lens is comprised of plastic.

12. The lamp device of claim 9 wherein the lens facilitates diffusion of light generated by the array of LEDs.

13. The lamp device of claim 9 wherein the lamp casing is aluminum and operative structured to perform as a heat sink.

* * * * *